US005094146A

United States Patent [19]

Molly

[11] Patent Number: 5,094,146

[45] Date of Patent: Mar. 10, 1992

[54] AXIAL PISTON TYPE MOTOR

[76] Inventor: Hans Molly, Dr.
Eugen-Essig-Strasse 48, 7502
Malsch, Fed. Rep. of Germany

[21] Appl. No.: 651,995

[22] Filed: Dec. 21, 1990

Related U.S. Application Data

[62] Division of Ser. No. 293,243, Jan. 4, 1989, Pat. No. 5,033,358.

[30] Foreign Application Priority Data

Jan. 4, 1988 [DE] Fed. Rep. of Germany ..... 3300031

[51] Int. Cl.[5] ..... F01B 3/00; F04B 1/12; F04D 1/30

[52] U.S. Cl. ..... 91/487

[58] Field of Search ..... 91/484, 485, 506, 505, 91/486, 487, 507

[56] References Cited

U.S. PATENT DOCUMENTS

| | | | |
|---|---|---|---|
| 1,975,758 | 10/1934 | Stuber . | |
| 2,445,232 | 7/1948 | Molly | 91/487 |
| 3,040,672 | 6/1962 | Foerster | 91/487 |
| 3,073,253 | 1/1963 | Schollhammer | 91/485 |
| 3,657,970 | 4/1972 | Kobayashi et al. | 91/485 |
| 3,760,692 | 9/1973 | Molly | 91/505 |
| 3,775,981 | 12/1973 | Molly . | |
| 3,799,033 | 3/1974 | Pruvot | 91/485 X |
| 3,933,082 | 1/1976 | Molly | 91/485 |
| 4,033,238 | 7/1977 | Wagenseil | 91/505 |
| 4,034,650 | 7/1977 | Molly | 91/485 |
| 4,382,399 | 5/1983 | Lotter | 91/486 |
| 4,422,367 | 12/1983 | Berthold | 91/484 |
| 4,602,554 | 7/1986 | Wagenseil et al. | 91/506 X |

*Primary Examiner*—Leonard E. Smith
*Attorney, Agent, or Firm*—Mallinckrodt & Mallinckrodt

[57] ABSTRACT

An axial piston type motor for a hydrostatic transmission, wherein the motor is arranged to generate an output torque at the drive flange uses a Rzeppa joint (32) to couple the drive flange (10) with the cylinder barrel (16). The center of the Rzeppa joint (32) is located in the tilting point (60) between the axes of the drive flange (10) and of the cylinder barrel (16). The number of balls (42) of the Rzeppa joint (32) is equal to the number of pistons (24). The outer joint member of the Rzeppa joint (32) is formed by the drive flange (10). The balls (42) and grooves (40) of the Rzeppa joint (32) are angularly offset with respect to the ball-and-socket joints (28,30) of the pistons (24) by half the angular spacing of the ball-and-socket joints and extend up to the space between the ball-and-socket joints. In connection therewith, different possibilities of guiding the cylinder barrel directly at the barrel support (12) or indirectly at the valving body, which itself is supported on the barrel support (12), are described. The frictional forces between valving body and the cylinder barrel are reduced by pressure fields. The valving body is relieved from hydraulic forces to ensure that the valving surface may align itself with the cylinder barrel (16).

12 Claims, 3 Drawing Sheets

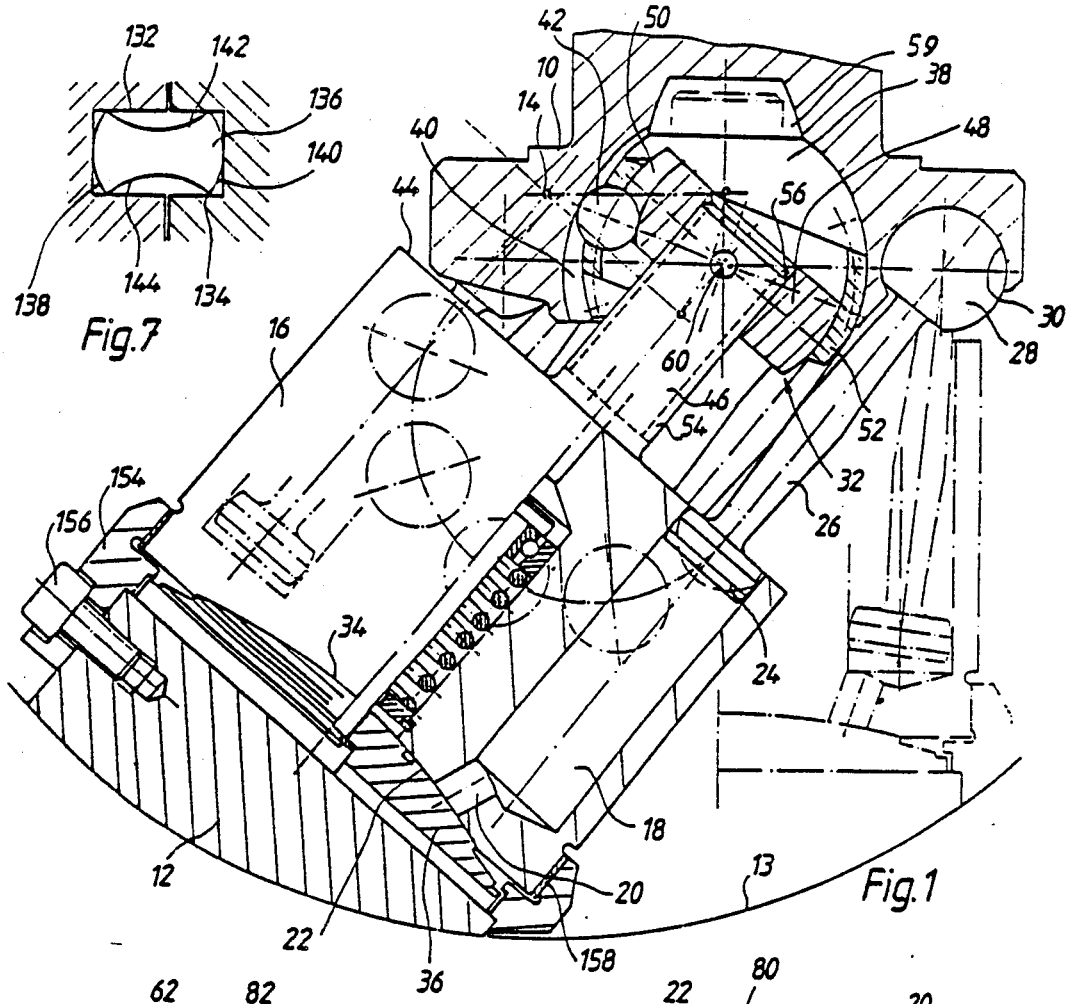
Fig.7
Fig.1
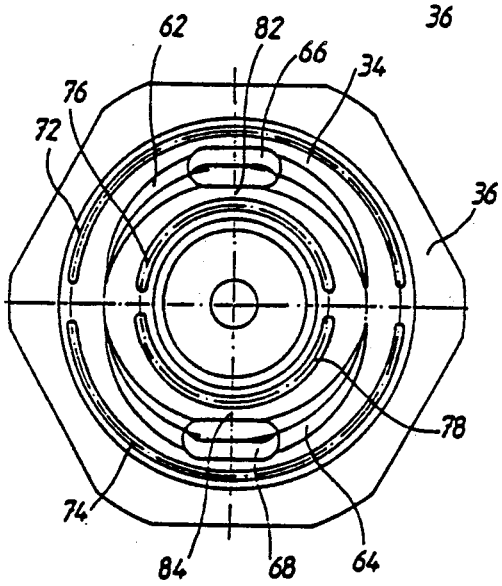
Fig.3
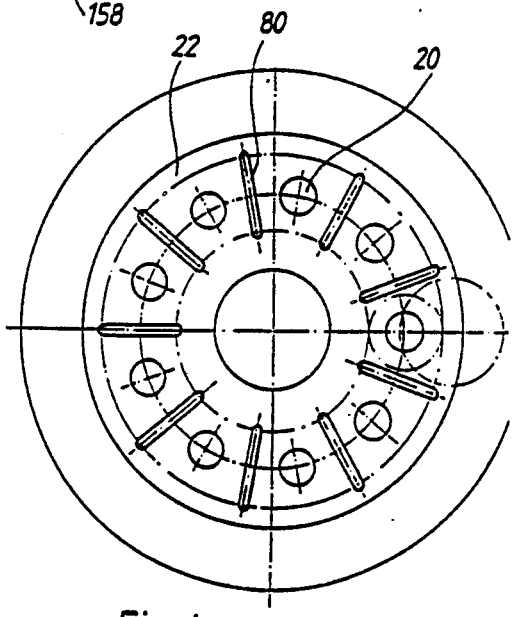
Fig. 4

36
37
66
86
88
68
70
132
90

100
112
116
124
120
39
104
108
94
92
106
102
110
118
126
114
122
96
134
98

10
150
59
152
30
28
26
16
66
36
39
92
12
112
104
100
108
120
166
128
164
134
154
162
130
110
114
102
154
106
37
122
68
158
20
24
18
36
84
82
132
160
170
158
156
168

AXIAL PISTON TYPE MOTOR

This is a division of application Ser. No. 07/293,243, filed 01/04/89, now U.S. Pat. No. 5,033,358.

TECHNICAL FIELD

The invention relates to an axial piston type motor of variable volume especially for but not restricted to a hydrostatic transmission having a pump a variable volume axial piston type motor.

In one embodiment of the invention, said axial piston type motor is arranged to generate an output torque at a drive flange. Such embodiment comprises (a) a drive flange mounted in a housing for rotation about a drive flange axis, (b) a cylinder barrel having an axis and a plurality of substantially axial cylinder bores open towards said drive flange and having an end face remote from said drive flange, said axial cylinder bores communicating through passages with ports in said remote end face, (c) pistons guided in said cylinder bores of said cylinder barrel and articulated at said drive flange by a circular array of ball-and-socket joints located on a circle about said drive flange axis, (d) a barrel support pivotable relative to the drive flange about a pivot axis located in a plane perpendicular to said drive flange axis, (e) said cylinder barrel being supported in said drive flange in a tilting point, said tilting point being the intersection of the axes of said drive flange and of said cylinder barrel, and said cylinder barrel being further supported in said barrel support, (f) a valving body supported in said barrel support and retained non-rotatably therein, said valving body having a valving surface with two diametrically opposite, arcuate valving ports, each valving port extending over slightly less than 180°, one of said valving ports communicating through a passage with a fluid inlet defined in said barrel support, and the other one of said valving ports communicating through a passage with a fluid outlet defined in said barrel support, said valving surface engaging said remote end face of said cylinder barrel, (g) a Rzeppa type joint arranged to homokinetically couple said cylinder barrel with said drive flange, said Rzeppa type joint comprising an inner joint member and an outer joint member, said members having aligned longitudinal groves therein, and said joint further comprising a number of balls is held in said grooves between said members to permit pivotal movement between said members about a center point, said center point coinciding with said tilting point, A Rzeppa joint is a well known homokinetic joint. It comprises an annular outer joint member having longitudinal grooves in its inner surface, and an inner joint member having longitudinal grooves in its outer surface. Balls are retained in these grooves between the outer and inner joint members. Longitudinally, the balls are held by a cage located between the outer and inner joint members. The grooves of the outer and inner joint members are curved about different centers of curvature such that the axes of the outer and inner joint members can be deflected to form an angle, while rotary motions of one member is homokinetically transmitted to the other member.

The invention also relates to an axial piston type motor, wherein valving means are hydraulically received from substantial axial forces to reduce the friction between the end face of the cylinder barrel and a valving surface. Such axial piston type motor may also be of the type wherein the torque is generated at the cylinder barrel, i.e. wherein the cylinders engage a swash pate through sliding shoes.

The term "stroke disc", herein, is to cover both a drive flange of an axial piston type motor, where in the torque is generated at this drive flange, and a swash plate of an axial piston type motor, wherein the torque is generated at the cylinder barrel.

BACKGROUND ART

U.S. Pat. No. 4,034,650 shows an axial piston type machine having a cylinder barrel mounted on a shaft. At one end, the shaft is centrally supported in a drive flange by means of a ball-and-socket joint. At its other end, the shaft is mounted in a pivotable barrel support. The cylinder barrel has a circular array of axial cylinder bores. Pistons with piston rods are guided in the cylinder bores. The piston rods are articulated on the drive flange through ball-and-socket joints. A disc s arranged between the cylinder barrel and the barrel support. The surface of the disc facing the barrel support is concave-spherical. The adjacent surface of the barrel support is of convex-spherical shape complementary to the shape of the surface of the disc. The disc is restrained against rotation. The surface of the disc adjacent the end face of the cylinder barrel is provided with diametrically opposite arcuate valving ports. Each of these valving ports extends through slightly less than 180°. The valving ports serve to communicate the cylinder bores alternatingly with a fluid inlet and with a fluid outlet.

In the axial piston type motor of U.S. Pat. No. 4,034,650, the torque is generated at the swash plate. The cylinder barrel is coupled with the swash plate to rotate therewith. In the motor of U.S. Pat. No. 4,034,650, this coupling is effected by the appropriately shaped piston rods engaging, in certain angular positions, the inner walls of the cylinder bores.

In one embodiment of U.S. Pat. No. 4,034,650, the barrel support is pivotable relative to the drive flange about a pivot axis, which is laterally spaced from the rotary axis of the drive flange. Thus the barrel support is pivoted "off-center". This does not affect the tilting point, i.e. the point of intersection of the drive flange axis and the barrel axis. This design offers the advantage, that the dead volume in the cylinder bores, which has to be compressed during each revolution, is reduced. This, in turn, increases the efficiency of the axial piston motor.

A similar axial piston type motor is disclosed in U.S. Pat. No. 3,933,082.

Coupling the cylinder barrel with the drive flange through the piston rods results in non-uniform rotation of the cylinder barrel, if the motor does not work at maximum tilting angle. This is undesirable.

U.S. Pat. No. 3,760,692 discloses an axial piston motor of similar type, wherein the cylinder barrel is coupled with the drive flange through meshing toroidal or conical toothed members on the drive flange and the cylinder block. The toothed members mesh along the angle bisector between the drive flange axis and the cylinder block axis. Also here, the cylinder barrel s tilted about an off-center axis.

U.S. Pat. No. 3,775,981 relates to a hydrostatic transmission. The hydrostatic transmission comprises a pump driven by a prime mover and a variable stroke axial piston type motor fed by the pump. The pump has constant delivery during normal operation. The intake volume per revolution of the motor is variable by pivoting the cylinder barrel about an off-center pivot axis through an angle of more than 30°, such that the dead volume in the cylinders is kept as small as possible. The intake volume per revolution of the motor at maximum pivot position is a multiple of the delivery volume per revolution of the pump. The cylinder block of the motor is carried along by the drive flange again through peripherally arranged teeth in mesh in the region of the pivot axis and permitting the pivoting movement of the cylinder barrel.

U.S. Pat. No. 3,775,981 illustrates the control of such a transmission. The pressure acting in the cylinders of the pump and motor result in a torque exerted by the cylinder barrel on the barrel support about the pivot axis. This torque is counteracted by a hydraulic actuator.

The pump delivers a constant fluid flow. The pressure in the system is controlled by a pressure control device. The pressure control device comprises a valve spool which is, at one end, engaged by a compression spring and, at the other end, exposed to the system pressure. The valve spool governs communication of the hydraulic actuator to either system pressure or to a reservoir. If the pressure increases, because the motor has to overcome higher resistance, the valve spool will be moved against the action of the compression spring and temporarily communicate the hydraulic actuator to the reservoir. Thus hydraulic fluid will flow out of the actuator and the cylinder barrel under the action of the said torque and the cylinder barrel will move to a position, where the barrel axis and the drive flange axis form a larger angle. The intake volume of the motor per revolution will be increased. The motor, therefore, will rotate more slowly, and the pressure in the system wi i drop, until a balance between compression spring force and system pressure has been reached again. The power of the motor can be varied by a control lever, by which the bias of the compression spring can be controlled.

Rzeppa joints are well known from various publications, for example U.S. Pat. No. 1,975,758; German utility model 8,402,784.3; French patent 849,676; German patent 889,851; French patent 1,497,696; German patent publication 1,183,318 and German patent application 3,636,243 and German patent publication 1,167,618.

It is also well known to use such a Rzeppa joint for coupling a cylinder barrel with the drive flange in axial piston type hydrostatic motors.

German patent publication 1,220,735 discloses an axial piston type motor, wherein the cylinder barrel is driven by the drive flange through a Rzeppa joint. In the motor of German patent publication 1,220,735, the outer joint member is a cup-shaped element provided on an axial projection of the cylinder barrel. The inner joint member is attached to a pin on the side of the drive flange. The drive flange has a central recess to accommodate the Rzeppa joint with its outer joint member. Ball-and-socket joints by which the piston rods are articulated to the drive flange are arranged in a circular array around this recess.

In the motor of German patent publication 1,220,735, the size of the Rzeppa joint is limited. This involves the risk that the Rzeppa joint is subjected to wear when transmitting the torques required to rotate the cylinder barrel. Such torques are mainly due to the frictional forces between the valving surface and the end face of the cylinder barrel and may become quite large, if the motor is operated with fluid under very high pressure. Increasing the dimensions of the Rzeppa joint results in an increase of the overall size of the whole motor. The Rzeppa joint may also interfere with the piston rods at large pivot angles and, thereby, limit the pivotal movement of the barrel support. Also off-center pivotal movement of the barrel support and of the cylinder barrel, as explained above, is not possible with the design of German patent publication 1,220,735.

German patent application 1,775,222 shows a hydrostatic transmission with an axial piston type motor, wherein the cylinder barrel is coupled with the drive flange by means of a Rzeppa joint. In this design, the outer joint member of the Rzeppa joint is arranged in a recess of the drive flange. The inner joint member is arranged on an axial projection of the cylinder barrel. The piston rods are articulated to the drive flange in a circular array around the recess and radially spaced therefrom.

German patent application also shows a valving body engaging with a valving surface the end face of the cylinder barrel. The valving body has valving ports in its valving surface for alternately connecting the cylinders of the cylinder barrel to a fluid inlet or a fluid outlet. This valving body is held in engagement with the end face of the cylinder barrel by a bolt extending centrally through the valving body. The bolt extends into a cavity within the cylinder barrel. A compression spring is located in this cavity and abuts, at on end, the outer race of a ball bearing retained at the end of the bolt and engages, at its other end, the end face of the cavity.

German patent application 3,522,716 discloses an axial piston type motor similar to that of German patent application 1,775,222. Also in this motor, the piston rods are articulated to the drive flange in a circular array radially spaced from the central recess, in which the Rzeppa joint is arranged. Piston rods and ball-and-socket joints are arranged in the same longitudinal planes as the grooves and balls of the Rzeppa joint. A central shaft, extending through the cylinder barrel is supported with a spherical surface on the spherical inner surface of the central recess of the drive flange.

German patent 941,246 shows pressure fields in the valving surface of an axial piston type motor.

German patent 1,051,602 shows a hydrostatic axial piston type motor, wherein arcuate grooves are provided radially outwards and radially inwards of the arcuate valving ports in the valving surface. These grooves are connected to the fluid inlet or to the fluid outlet through passages drilled in the valving body below the valving surface.

DISCLOSURE OF THE INVENTION

It is an object of the invention to minimize, in an axial piston type motor of the type defined in the beginning, the radial dimensions of the drive flange and thus the mass of the whole motor.

It is a further object of the invention to permit the use of a sufficiently large Rzeppa joint, while minimizing the size of the drive flange.

It is a still further object of the invention to reduce the torque to be transmitted to the cylinder barrel through the Rzeppa joint due to friction between the valving surface and the adjacent end face of the cylinder barrel.

It is a still further object of the invention to provide an axial piston type motor of the type defined in the beginning, which permits off-center pivoting of the barrel support through large pivoting angles, the axis of the cylinder barrel passing always through a fixed tilting point on the axis of the drive shaft.

According to the invention, a hydrostatic transmission with a pump is provided, said axial piston type motor arranged to generate an output torque at a drive flange mounted in a housing for rotation about a drive flange axis. A cylinder barrel has an axis and a plurality of substantially axial cylinder bores open towards said drive flange and has an end face remote from said drive flange. The axial cylinder bores communicate through passages with ports in said remote end face. Pistons are guided in said cylinder bores of said cylinder barrel and are articulated at said drive flange by a circular array of ball-and-socket joints located on a circle about said drive flange axis. A barrel support is pivotable relative to the drive flange about a pivot axis located in a plane perpendicular to said drive flange axis. This cylinder barrel is supported in said drive flange in a tilting point, said tilting point being the intersection of the axes of said drive flange and of said cylinder barrel. The cylinder barrel is further supported in said barrel support. A valving body is supported in said barrel support and retained non-rotatably therein. The valving body has a valving surface with two diametrically opposite, arcuate valving ports, each valving port extending over slightly less than 180°. One of said valving ports communicates through a passage with a fluid inlet defined in said barrel support. The other one of said valving ports communicates through a passage with a fluid outlet defined in said barrel support. The valving surface engages said remote end face of said cylinder barrel. A Rzeppa type joint is arranged to homokinetically couple said cylinder barrel with said drive flange. This Rzeppa type joint comprises an inner joint member and an outer joint member. These members have aligned longitudinal grooves therein. The joint further comprises a number of balls held in said grooves between said members to permit pivotal movement between said members about a center point. This center point coincides with said tilting point. The number of balls of the Rzeppa type joint is equal to the number of pistons. The outer joint member of the Rzeppa type joint is integral with the drive flange. The balls and grooves of said Rzeppa type joint are angularly offset relative to said ball-and-socket joints by half the angular spacing between said ball-and-socket joints. The grooves extend radially into the space between said ball-and socket joints. The pivot axis of said barrel support is substantially tangential to said circle. The cylinder barrel is axially movable relative to said inner joint member to an extent permitting tilting of said cylinder barrel about said tangential pivot axis of said barrel support.

Thus the grooves of the Rzeppa joint extend between the ball-and-socket joints of the pistons. Thereby the diameter of the Rzeppa joint can be increased, and thereby the Rzeppa joint can be made more rugged, without increasing the diameter of the drive flange. The small diameter of the drive flange permits large pivot angles of the barrel support and of the cylinder barrel. Even at such large pivot angles, the pistons and piston rods will not interfere with the Rzeppa joint. The Rzeppa joint permits axial movement of the cylinder barrel relative to the inner joint member. This, in turn, permits pivoting of the cylinder barrel about an off-center pivot axis. Such off-center pivotal movement of the cylinder barrel ensures minimum dead volume and thus high efficiency of the motor.

If the cylinder barrel axis forms a large angle with the drive flange axis, the balls in the Rzeppa joint have to make large movements in their grooves during each revolution. This results in friction and the development of heat. As, however, the axial piston type motor rotates at a low speed, when the cylinder barrel is pivoted through a large angle, the speed of the balls in their grooves will not become excessively high. When the cylinder barrel axis forms a small angle with the drive flange axis, the cylinder barrel rotates at high speed. In this case, however, the balls make only small movements during each revolution. Thus also in this case the movement of the balls does not become excessively high. Therefore, the mode of use of the motor as a variable stroke motor in a hydrostatic transmission contributes to increasing the useful life of the Rzeppa joint.

Another feature of the invention is the reduction of the torque which has to be transmitted by the Rzeppa joint. This reduction of the torque is achieved by pressure fields between the valving surface and the adjacent end face of the cylinder barrel. Such pressure fields are so dimensioned, that the hydraulic forces exerted thereby on the cylinder barrel are Just slightly smaller than the hydraulic forces acting on the cylinder barrel due to the hydraulic pressure in the cylinders acting on the end faces of the cylinders. The reaction force of the hydraulic forces exerted by the pressure fields between valving surface and cylinder barrel would press the valving body against the barrel support and thereby, would prevent movement of the valving body into alignment with the cylinder barrel. Therefore additional pressure fields are provided between the valving body and the barrel support. Appropriate supporting means on the barrel support in conjunction with these pressure fields permit accurate alignment of the valving body with the cylinder barrel. The specification hereinbelow describes several designs of pressure fields between valving surface and cylinder barrel, of pressure fields between valving body and barrel support and of supporting means for supporting the valving body adjustable on the barrel support.

Thus the invention achieves long useful life of a Rzeppa joint in axial piston type hydrostatic motors by a design permitting large diameter of the Rzeppa joint and thereby rugged construction of the joint, by a particular mode of application as a variable stroke motor of a hydrostatic transmission, whereby the speed of the balls of the Rzeppa joint are kept within tolerable limits, and by reducing the torque to be transmitted by the Rzeppa joint. Ail this is done without impeding the other vita characteristics of the motor such as high efficiency.

Other objects and features will be apparent to anybody skilled in the art when reading the following description of preferred embodiments in conjunction with the accompanying drawings.

BRIEF DESCRIPTION OF THE DRAWINGS

FIG. 1 is a partially sectional side view of an axial piston type motor.

FIG. 3 shows the valving surface of the valving body in the axial piston type motor of FIGS. 1 and 2.

FIG. 4 shows the end face of the cylinder barrel engaging the valving surface of the valving body in the axial piston type motor of FIGS. 1 and 2.

FIG. 7 shows a detail at an enlarged scale.

BEST MODE OF CARRYING OUT THE INVENTION

Figure 5:
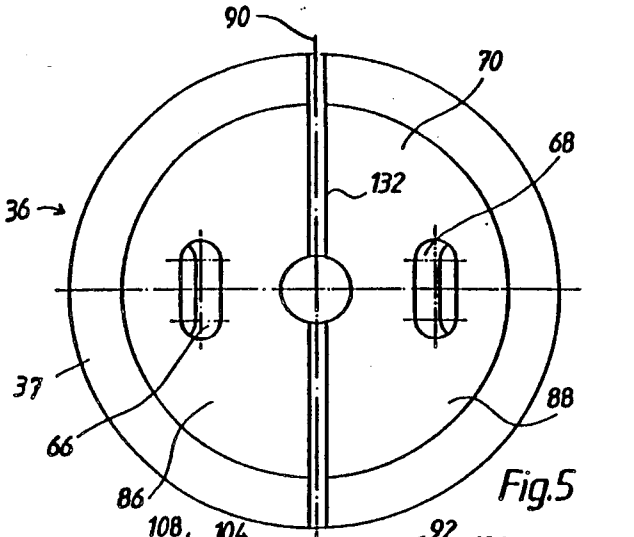
FIG. 5 shows the surface of the valving body on the side of the barrel support in the axial piston type motor of FIGS. 1 and 2.
Figure 6:
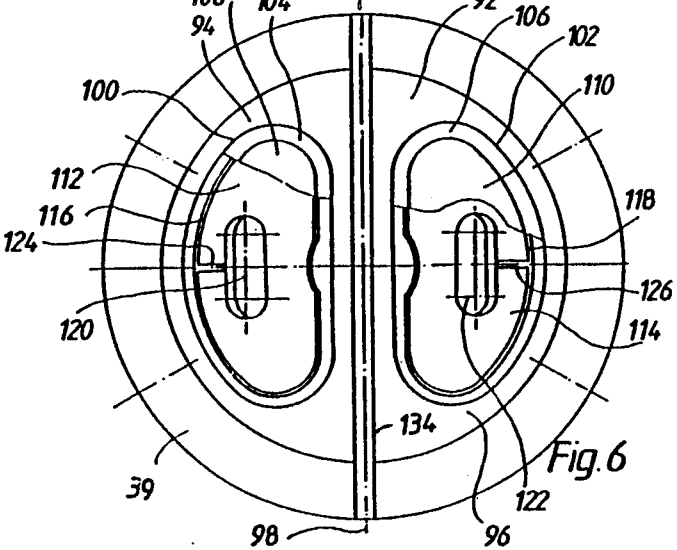
FIG. 6 shows the surface of the barrel support adjacent the valving body in the axial piston type motor of FIGS. 1 and 2.
Figure 2:
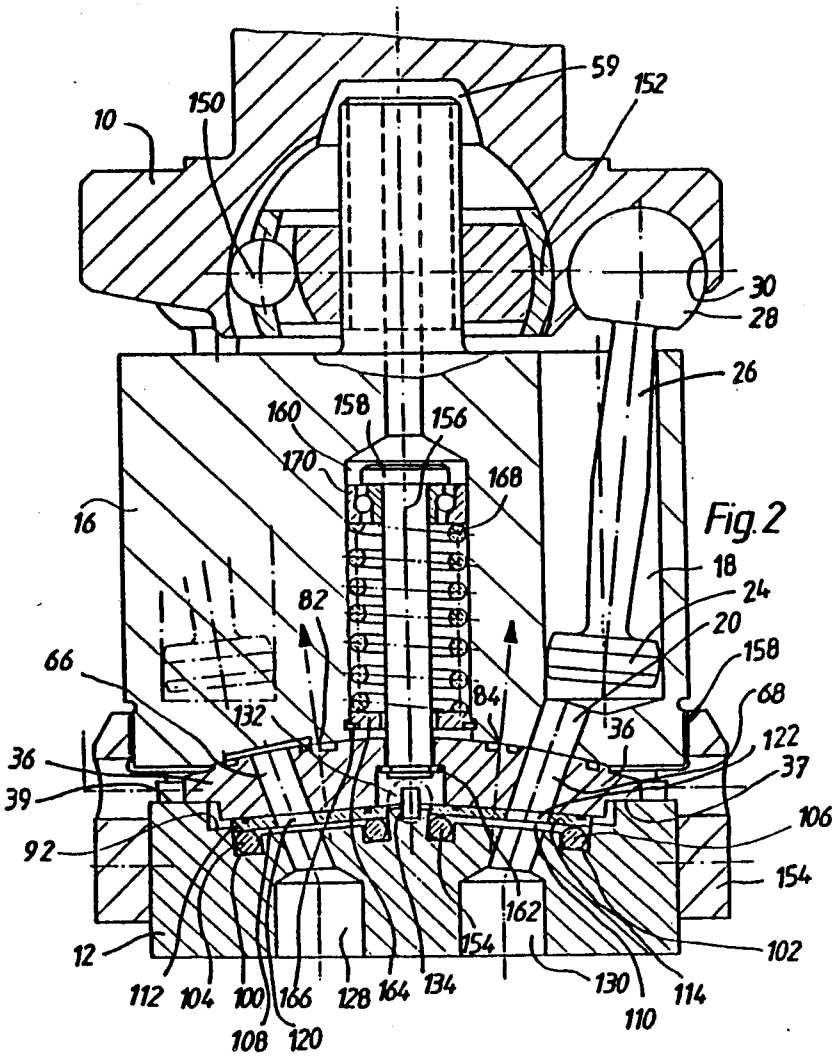
FIG. 2 shows a longitudinal section through the axial piston type motor of FIG. 1 perpendicular to the paper plane of FIG. 1.

The axial piston type motor has a drive flange 10 rotatably mounted in a casing (not shown). A barrel support 12 is pivotably mounted in the casing about an axis 14 by means of a guiding surface 13. A cylinder barrel is designated by 16. The cylinder barrel 16 has a circular array of axial cylinder bores 18, as indicated by dotted lines in FIG. 1. The cylinder bores 18 are connected to passages 20 ending in an end face 22 on the side of the barrel support. Pistons 24 are guided in the cylinder bores 18. The pistons 24 have piston rods 26. The piston rods 26 end in joint balls 28. The joint balls 28 are retained in spherical recesses 30 of the drive flange 10. Thus the piston rods 26 are articulated through ball-and-socket joints forming a circular array on the drive flange. As can be seen from FIG. 1 and in particular from FIG. 4, altogether, nine cylinder bores 18 with pistons 24 and piston rods 26 as well as ball-and-socket joints 28,30 are provided. The cylinder barrel 16 is coupled with the drive flange 10 through a Rzeppa joint 32 described hereinbelow. The end face 22 of the cylinder barrel 16 engages a valving surface 34 of a valving body 36. The valving body 36 itself is supported with a planar annular surface 37 on a likewise planar annular surface 39 of the barrel support 12.

The outer joint member of the Rzeppa joint 32 is integral with the drive flange 10, which, to this end, has a central recess 38. Grooves 40 are formed in the wall of the recess 38. Balls 42 of the Rzeppa joint 32 are guided in the grooves 40. A central projection 46 is provided on the cylinder barrel 16 on the end face 44 thereof adjacent to the drive flange 10. The inner joint member 48 of the Rzeppa joint 32 is guided on this projection 46. The inner joint member 48 has grooves 50 in its outer surface. The balls 42 are also guided in these grooves 50. The balls 42 are retained by a cage 52. The cage 52 extends between the outer joint member of the Rzeppa joint 32, that is the inner surface of the recess 38 of the drive flange 10, and the inner joint member 48.

The Rzeppa joint 32 has nine grooves 40, nine grooves 50 and nine balls 42, that is exactly the number of the cylinder bores 18 and pistons 24 of the axial piston type motor. The grooves 40 are angularly offset relative to the spherical recesses 30 of the ball-and-socket joints by half the angular spacing between said ball-and-socket joints, and extend radially into the space between these recesses 30 and ball-and-socket joints.

The axial projection 46 of the cylinder barrel 16 is a splined pin. The inner joint member 48 is non-rotatably guided on the splined surface 54 with a corresponding splined inner surface 56. The number of keys in the splined surface 54 and, correspondingly, the number of key grooves in the splined inner surface 56 of the inner joint member 48 is also equal to the number of cylinder bores 18 and pistons 24 in the cylinder barrel. Thus the splined surfaces 54 and 56 have nine keys and key grooves, respectively. The keys of the splined surface 54 and the key grooves 56 of the inner joint member 48 are angularly offset with respect to the grooves 50 formed in the outer surface of the inner joint member by half the angular spacing of these outer grooves. Thus the dimensions of the inner joint member 48 can be kept small without inadmissably weakening the structure. The key grooves 56 may radially extend up to between the grooves 50.

A truncated conical recess 58 communicates with the recess 58. When the cylinder barrel 16 is pivoted back to the zero stroke position, as illustrated in FIG. 1 by dotted lines, then the tilting point 60, that is the intersection point of the axes of drive flange 10 and cylinder barrel 16, is not changed. The cylinder barrel 16, however, pivots with the barrel support 12 about the off-center pivot axis 14. The projection 46 slides in the inner joint member 48 of the Rzeppa joint 32 and moves into the recess 58. This is also indicated in FIG. 1 by dotted lines. Due to the described construction the Rzeppa joint 32 may be constructed sufficiently rugged even with small radial dimensions of the axial piston type motor. The cylinder barrel 16 can be pivoted about an off-center pivot axis 14. An axial loading of the Rzeppa joint 32 by the cylinder barrel is prevented. The small radial dimensions of the drive flange 10 and of the cylinder barrel 16 permit a large pivot angle, as can be seen from FIG. 1. High efficiency of the axial piston type motor results from the large pivot angle and from the reduction of the dead volume.

The valving surface 34 of the valving body 36 is convex-spherical. The end face 22 of the cylinder barrel 16 of concave-spherical shape complementary thereto engages the valving surface 34. These two surfaces are illustrated in FIG. 3 and FIG. 4.

The valving surface has two crescent-shaped valving ports 62 and 64. The valving ports 62,64 extend through slightly less than 180. The valving ports are connected through passages 66 and 68, respectively, of oval cross section to the rear surface 70 of the valving body 36 on the side of the barrel support. This surface 70 is illustrated in FIG. 5. The two valving ports 62 and 64 are surrounded radially outwardly by arcuate grooves 72 and 74, respectively, extending also through almost 180. Arcuate grooves 76 and 78, respectively, extending through almost 180 are provided radially inwardly of the valving ports 62 and 64.

The passages 20 end in the end face 22 of the cylinder barrel 16. Radial grooves 80 extend between the passages 20. The grooves 80 are connected to the valving ports 62 or 64. Thereby oil films are formed between the grooves 80, and are limited circumferentially by the two grooves 80 just communicating with the respective valving port, and radially to the inside and to the outside by the arcuate grooves 72, 76 and 74, 78, respectively. These oil films form pressure fields with centers of force 82 and 84, respectively. These pressure fields exert forces tending to lift the cylinder barrel from the valving body 36. These forces are counteracted by forces exerted by the fluid pressure on the end faces of the cylinder bores 18.

The surface 70 of the valving body 36 consists of two halves 86 and 88 forming an obtuse angle on both sides of a center line 90. The surface 70 is supported on a surface 92 of the barrel support 12. The surface 92 is slightly roof-shaped complementary to the surface 70 of the valving body 36. Arcuate grooves 100 and 102 are provided in the two halves 94 and 96 of the surface 92 symmetrically to the center line 98, one groove in each surface. Sealing rings 104 and 106 are placed in the grooves 100 and 102, respectively. Pressure areas 108 and 110, respectively, are defined by the sealing rings 104 and 106. Disks 112 and 114 are arranged on the sealing rings 104 and 106, respectively. The discs 112 and 114 have the shapes of the pressure fields 108 and 110, respectively.

The valving body 36 engages the discs 112 and 114. In their surfaces facing the valving body 36, the discs 112 and 114 have grooves 116 and 118, respectively, extending along a closed path following approximately the contour of the pressure fields 108 and 110, respectively. The discs 112 and 114 have apertures 120 and 122, respectively, communicating with the passages 66 and 68, respectively, of the valving body 36. The apertures 120 and 122 are connected through grooves 124 and 126, respectively, to the apertures 120 and 122, respectively.

The apertures 120 and 122 communicate with the pressure fields 108 and 110, respectively. These pressure fields 108 and 110 are, in turn, connected to a fluid inlet 128 and a fluid outlet 130, respectively.

In its surface 70, the valving body 36 has a straight groove 132 of rectangular cross section extending along the center line 90. A corresponding groove 134 is provided in the surface 92 of the barrel support 12 along the center line 98. The two grooves 132 and 134 together define a passage of rectangular cross section. As may be seen best from FIG. 7, a prismatic guiding element 136 is arranged in this passage. The guiding element has two convex-cylindrical side surfaces 138 and 140 engaging the bottoms of the grooves 132 and 134, respectively, and has two concave-cylindrical side surfaces 142 and 144 therebetween. This guiding element permits relative displacement of valving body 36 and barrel support 12 parallel to the center lines 90 and 98. It also permits a limited lateral compensating movement, during which the convex-cylindrical side faces 138 and 140 roll off on the bottom surfaces of the grooves 132 and 134, respectively.

The pressure fields 108 and 110 are arranged such, that each of them generates a force passing through the center of force 82 and 84, respectively of the pressure field formed between the valving surface 34 and the end face 22 of the cylinder barrel, and directed perpendicularly to this spherical valving surface 34. When the axial piston type motor is dimensioned correctly, these pressure fields and the curvature of the valving surface are chosen such that the forces exerted by the pressure fields on the cylinder barrel 16 pass through the centers of force of the forces with which the pistons 24 are supported on the drive flange 10. These centers of force are formed on the pressure and intake side, and the forces are only slightly smaller than these supporting forces. Then the forces exerted on the cylinder barrel by the fluid in the cylinder bores are nearly compensated by these pressure fields such that the cylinder barrel 16 engages the valving surface 34 with small force only. Now the pressure fields 108 and 110 generate again forces also passing through the centers of force 82,84 of the pressure fields formed between valving surface 34 and end face 22, the forces being perpendicular to the valving surface 34. Thus these forces pass substantially also through the centers of force of the supporting forces of the pistons 18 at the drive flange 10. These centers of force 150 and 152 are located on the straight line extending through the tilting point 60 parallel to the pivot axis 14 at a distance of 2r/of the tilting point 60, when r is the radius of the circle on which the centers of the joint balls 28 are located.

In the embodiment of FIG. 1 to 6, the cylinder barrel 16 is held in the barrel support 12 by a guiding ring 154 attached by means of screws 156. The guiding ring 154 has a sliding bearing ring 158 in which the cylinder barrel 16 is mounted.

The pressure fields 108 and 110 relieve the valving body 36 from forces such that the valving body may carry out compensating movements within the framework of the guiding of FIG. 7, and may exactly align itself with the end face 22 of the cylinder barrel 16. Thus no over-determination by the spherical surfaces 22 and 34, on one hand and the sliding bearing ring 158, on the other hand, occurs.

A central stepped bore 154 forming a shoulder is provided in the central body 36. A bolt 156 having a head 158 is located in a bore 160 of the cylinder barrel 16 and extends into the stepped bore 154. The end of the bolt 156 is secured in the stepped bore 154 by means of a snap ring 162 engaging the shoulder of the stepped bore 154. An annular disc 164 is held in the bore 160 by means of a snap ring 166. A coil spring 168 engages the annular disc 164. The coil spring 168 surrounds the bolt 156 in the bore 160. The coil spring 168, at the other end, engages the outer race of a ball bearing 170. The inner race of the ball bearing 170 engages the head 158 of the bolt 156. Thus the cylinder barrel 16 is held in engagement with the valving surface 34 of the valving body 36 independently of the oil pressure. The valving body 36 is stationary. The cylinder barrel 16 rotates together with the coil spring 168. The relative motion is permitted by the ball bearing 170.

In the described axial piston type motor the Rzeppa joint exactly determines the tilting point, that is the intersection point of the axes of drive flange 10 and cylinder barrel 16. The cylinder barrel 16 is held in this tilting point 60, on one side. On the other side the cylinder barrel 16 is guided at its outside by the barrel support 12, namely through the sliding bearing ring 158. The position of the cylinder barrel 16 is thus determined unambiguously. The valving body 36 is arranged to align itself with the cylinder barrel. The valving body is relieved from hydraulic forces such that also no transversal forces act on the valving body 36. The valving body 36, in turn, is guided through the planar annular surfaces 37 and 39 on the barrel support 12. Thus, in this embodiment, the cylinder barrel 16 is directly guided at the barrel support 12.

In all embodiments the cross sectional areas of the passages between cylinder bore and valving surface and between the valving surface and the fluid inlet and fluid outlet, respectively, are chosen substantially smaller than the cross sectional areas of the cylinder bores, the valving ports and the pressure fields. Thereby the dead volume of the axial piston type motor is reduced.

The axial piston type motor of the invention is useful wherever axial piston type motors are used and is particularly useful, as indicated, in in hydrostatic transmission. Particular embodiments of hydrostatic transmissions using axial piston type motors are shown in my U.S. Pat. No. 3,775,981.

Figure 8:
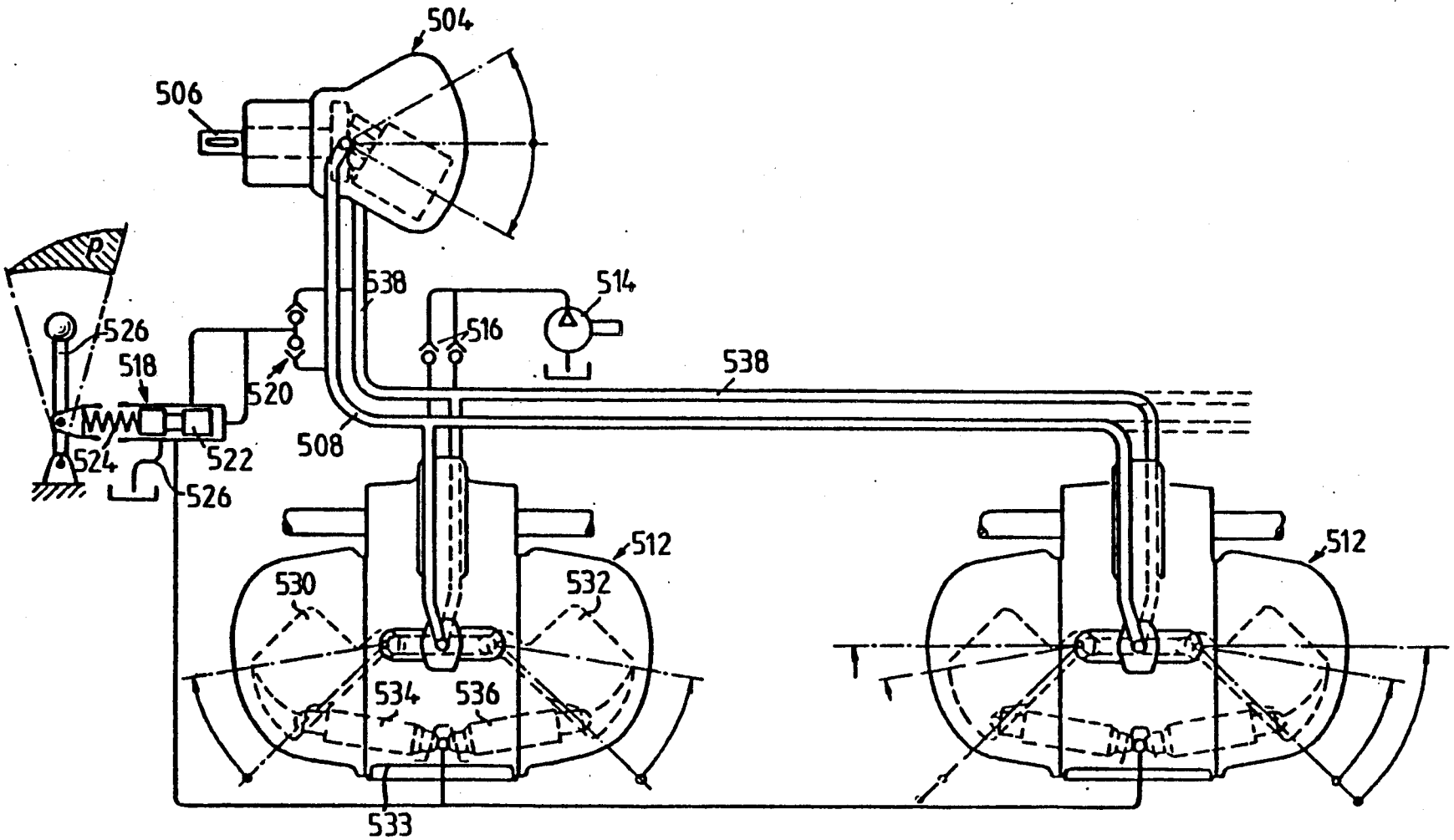
FIG. 8, a schematic diagram of a transmission in which axial piston type motors of the invention may be used.

FIG. 8 shows schematically a particular embodiment of hydrostatic transmission with which the invention can be used. This is similar to the transmission of FIGS. 12 and 13 of U.S. Pat. No. 3,775,981. A fluid pump 504 is driven by a drive shaft 506 coupled to the output of a prime mover, not shown. The pump is pivotable 30° to both sides of a zero position. The zero position corresponds to idling or stop. The pump can then be started forwards or backwards until the pump has attained its pivot position of +30° or −30°. At one pivoted position, oil is pumped through a conduit 508 to the motor assemblies, generally 510, 512, etc., and returns through conduit 538. In the opposite pivoted position, oil is pumped through conduit 538 while it returns through conduit 510. A filling pump 514 supplies filling oil into the system through check valves 516. There is a pressure regulator, generally 518, which keeps the oil pressure constant in whichever conduit 508 or 538 is serving as the supply conduit, through a check valve arrangement 520. The pressure regulator 518 includes a slide 522 which is biased by a spring 524 and controls the fluid communication between the supply conduit 508 or 538 and an outlet 526. The force exerted by the spring 524 is adjusted by a control lever 528. The greater the force applied by the spring the greater will be the pressure in the supply conduit (508 or 538) and the less the force, the less the pressure.

Each motor assembly includes two axial piston type motors 530, 532 which are articulated in pivotable frames so as to pivot in an off-center manner in a housing 533, in which the drive flanges of the respective motors are rotatably mounted for rotation about a drive flange axis. The hydraulic moments acting on the pivotable frames are taken up by the adjusting cylinders 534, 536, which adjust the angular position of the motor cylinder barrels with respect to their drive flanges. The drive flanges are coupled to shafts extending from the motor assemblies 510, 512, etc., such as to shafts 540 and 542 extending from housing 533 so that rotation of the drive flanges cause rotation of the shafts. Further details of the transmission of FIG. 19, as well as alternate transmission embodiments, are contained in the referenced U.S. Pat. No. 3,775,981, which is incorporated herein by reference.

Whereas this invention is here illustrated and described with specific reference to embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A variable volume axial piston type motor, comprising (a) a drive flange mounted in a housing for rotation about a drive flange axis, (b) a cylinder barrel having an axis and a plurality of substantially axial cylinder bores open toward said drive flange and having an end face remote from said drive flange, said axial cylinder bores communicating through passages with ports in said remote end face, (c) pistons guided in said cylinder bores of said cylinder barrel and articulated at said drive flange by a circular array of ball-and-socket joints located on a circle about said drive flange axis, (d) a barrel support pivotable relative to the drive flange axis about a pivot axis located in a plane perpendicular to said drive flange axis, (e) said cylinder barrel being supported in said drive flange in a tilting point, said tilting point being the intersection of the axes of said drive flange and of said cylinder barrel, (f) guiding means on said barrel support for holding said cylinder barrel radially relative to said barrel support at a distance from said tilting point, said guiding means guiding said cylinder barrel axially movably, (g) a valving body supported by said barrel support and retained non-rotatably thereto, said valving body having a valving surface with two diametrically opposite, arcuate valving ports, each valving port extending through slightly less than 180°, one of said valving ports communicating through a passage with a fluid inlet defined in said barrel support; and the other one of said valving ports communicating through a passage with a fluid outlet defined in said barrel support, said valving port engaging said remote end face of said cylinder barrel, (h) said valving body being movable relative to said barrel support to permit alignment of said valving surface with said remote end face of said cylinder barrel, (i) coupling means for coupling said cylinder barrel with said drive flange to rotate said cylinder barrel substantially in synchronism with said drive flange, (j) wherein said remote end face of said cylinder barrel has radial grooves therein between said ports in said remote end face.

2. A variable volume axial piston type motor as claimed in claim 1, wherein said valving surface of said valving body has arcuate grooves therein radially inward and radially outward of each of said arcuate valving ports.

3. A variable volume axial piston type motor, comprising (a) a drive flange mounted in a housing for rotation about a drive flange axis, (b) a cylinder barrel having an axis and a plurality of substantially axial cylinder bores open toward said drive flange and having an end face remote from said drive flange, said axial cylinder bores communicating through passages with ports in said remote end face, (c) pistons guided in said cylinder bores of said cylinder barrel and articulated at said drive flange by a circular array of ball-and-socket joints located on a circle about said drive flange axis, (d) a barrel support pivotable relative to the drive flange axis about a pivot axis located in a plane perpendicular to said drive flange axis, (e) said cylinder barrel being supported in said drive flange in a tilting point, said tilting point being the intersection of the axes of said drive flange and of said cylinder barrel, (f) guiding means on said barrel support for holding said cylinder barrel radially relative to said barrel support at a distance from said tilting point, said guiding means guiding said cylinder barrel axially movably, (g) a valving body supported by said barrel support and retained non-rotatably thereto, said valving body having a valving surface with two diametrically opposite, arcuate valving ports, each valving port extending through slightly less than 180°, one of said valving ports communicating through a passage with a fluid inlet defined in said barrel support, and the other one of said valving ports communicating through a passage with a fluid outlet defined in said barrel support, said valving surface engaging said remote end face of said cylinder barrel, whereby an inlet pressure prevails in cylinders communicating with said one valving port and an outlet pressure prevails in cylinders communicating with said other valving port, said pressures exerting inlet and outlet piston forces, respectively, on said pistons which are supported by said drive flange, said piston forces due to said inlet and outlet pressures defining inlet and outlet centers of force, (h) said valving body being movably supported on said barrel support to permit alignment of said valving surface with said remote end face of said cylinder barrel, (i) coupling means for coupling said cylinder barrel with said drive flange to rotate said cylinder barrel substantially in synchronism with said drive flange, (j) said valving surface of said valving body being convex-spherical, said remote end face of said cylinder barrel engaged thereby being of concave-spherical shape complementary thereto, (k) first pressure fields defined in said valving surface between said valving body and said cylinder barrel, each of said first pressure fields surrounding one of said arcuate valving ports, each of said pressure fields defining a center of force and exerting a force on said cylinder barrel, the forces exerted on said cylinder barrel by said inlet and outlet pressure fields passing through said centers of force of said inlet and outlet piston forces, respectively, and (l) second pressure fields provided between said valving body and said barrel support, said second pressure fields being in line with a plane perpendicular to said axis of the cylinder barrel to generate forces which are normal to said spherical valving surface and pass through said centers of force of said inlet and outlet piston forces, respectively.

4. An axial piston type motor as claimed in claim 3, wherein said end face of the cylinder barrel has radial grooves therein between said ports in said remote end face.

5. An axial piston type motor as claimed in claim 4, wherein said valving surface of said valving body has arcuate grooves therein radially inward and radially outward of each said arcuate valving ports.

6. An axial piston type motor as claimed in claim 3, wherein plates having substantially the shape of said pressure fields are arranged between said barrel support and said valving body, said plates, on the side of said barrel support, being supported on O-rings, said pressure fields being defined within said O-rings and communicating with said fluid inlet or fluid outlet, respectively, said plates, in turn, engaging said valving body with seals therebetween.

7. A variable volume axial piston type motor comprising (a) a stroke disc, (b) a cylinder barrel having an axis and a plurality of substantially axial cylinder bores open toward said stroke disc and having an end face remote from said stoke disc, said axial cylinder bores communicating through passages with ports in said remote end face, (c) pistons guided in said cylinder bores of said cylinder barrel and supported on said stroke disc on a circle, said stroke disc and said cylinder barrel being relatively pivotable about a pivot axis substantially tangential to said circle;

(d) a barrel support, said cylinder barrel being mounted for rotation relative to said barrel support, (e) said cylinder barrel being supported in a tilting point in said stroke disc, said cylinder barrel being further supported in said barrel support, (f) a valving body supported in said barrel support and retained non-rotatably therein, said valving body having a valving surface with two diametrically opposite, arcuate valving ports, each valving port extending over slightly less than 180°, one of said valving ports communicating through a passage with a fluid inlet defined in said barrel support, and the other one of said valving ports communicating through a passage with a fluid outlet defined in said barrel support, said valving surface engaging said remote end face of said cylinder barrel, wherein (g) said valving surface of said valving body is convex-spherical, said remote end face of said cylinder barrel engaged thereby being of concave-spherical shape complementary thereto, (h) said valving body is guided on the barrel support non-rotatably but laterally movably to permit lateral alignment of the valving body with the cylinder barrel, (i) pressure fields are defined between said valving body and said barrel support, said pressure fields being connected to fluid pressure to generate forces which pass though the centers of force of said pressure fields and are normal to said spherical valving surface, (j) said pivot axis of said barrel support being substantially tangential to said circle, and (k) said end face of the cylinder barrel having radial grooves therein between said ports in said remote end face.

8. An axial piston type motor as claimed in claim 7, wherein said valving surface of said valving body has arcuate grooves therein radially inward and radially outward of each said arcuate valving ports.

9. A variable volume axial piston type motor comprising (a) a stroke disc, (b) a cylinder barrel having an axis and a plurality of substantially axial cylinder bores open towards said stroke disc and having an end face remote from said stroke disc, said axial cylinder bores communicating through passages with ports in said remote end face, (c) pistons guided in said cylinder bores of said cylinder barrel and supported on said stroke disc on a circle, said stroke disc and said cylinder barrel being relatively pivotable about a pivot axis substantially tangential to said circle.

(d) a barrel support, said cylinder barrel being mounted for rotation relative to said barrel support, (e) said cylinder barrel being supported in a tilting point in said stroke disc, said cylinder barrel being further supported in said barrel support, (f) a valving body supported in said barrel support and retained non-rotatably therein, said valving body having a valving surface with two diametrically opposite, arcuate valving ports, each valving port extending over slightly less than 180°, one of said valving ports communicating through a passage with a fluid inlet defined in said barrel support, and the other one of said valving pots communicating through a passage with a fluid outlet defined in said barrel support, said valving surface engaging said remote end face of said cylinder barrel, wherein (g) said valving surface of said valving body is convex-spherical, said remote end face of said cylinder barrel engaged thereby being of concave-spherical shape complementary thereto, (h) said valving body is guided on the barrel support non-rotatably but laterally movably to permit lateral alignment of the valving body with the cylinder barrel, (i) pressure fields are defined between said valving body and said barrel support, said pressure fields being connected to fluid pressure to generate forces which pass through the centers of force of said pressure fields and are normal to said spherical valving surface, (j) said pivot axis of said barrel support being substantially tangential to said circle, and (k) wherein plates having substantially the shape of said pressure fields are arranged between said barrel support and said valving body, said plates, on the side of said barrel support, being supported on O-rings, said pressure fields being defined within said O-rings and communicating with said fluid inlet and fluid outlet, respectively, said plates, in turn, engaging said valving body with seals therebetween.

10. A variable volume axial piston type motor comprising (a) a drive flange mounted in a housing for rotation about a drive flange axis, (b) a cylinder barrel having an axis and a plurality of substantially axial cylinder bores open toward said drive flange and having an end face remote from said drive flange, said axial cylinder bores communicating through passages with pts in said remote end face, (c) pistons guided in said cylinder bores of said cylinder barrel and articulated at said drive flange by a circular array of ball-and-socket joints located on a circle about said drive flange axis, (d) a barrel support pivotable relative to the drive flange about a pivot axis located in a plane perpendicular to said drive flange axis, (e) said cylinder barrel being supported by joint means in said drive flange in a tilting point, said tilting point being the intersection of the axes of said drive flange and of said cylinder barrel, and said cylinder barrel being further supported in said barrel support, said joint means comprising an inner joint member means and an outer joint member means and arranged to permit pivotal movement between said members about said tilting point, (f) a valving body supported in said barrel support and retained non-rotatably therein, said valving body having a valving surface with two diametrically opposite, arcuate valving ports, each valving port extending over slightly less than 180°, one of said valving ports communicating through a passage with a fluid inlet defined in said barrel support, and the other one of said valving ports communicating through a passage with a fluid outlet defined in said barrel support, said valving surface engaging said remote end face of said cylinder barrel, said cylinder barrel being supported on said drive flange through shaft means coaxial therewith, said inner joint member of said joint means being movable longitudinally on said shaft means, (g) said drive shaft having a recess aligned with the axis of said drive flange, and an end of said shaft means sliding in said inner joint means so as to move into said recess when said cylinder barrel is moved toward a position in which the axes of the drive flange and of the cylinder barrel are aligned.

11. A variable volume axial piston type motor comprising (a) a drive flange mounted in a housing for rotation about a drive flange axis, (b) a cylinder barrel having an axis and a plurality of substantially axial cylinder bores open toward said drive flange and having an end face remote from said drive flange, said axial cylinder bores communicating through passages with ports in said remote end face, (c) pistons guided in said cylinder bores of said cylinder barrel and articulated at said drive flange by a circular array of ball-and-socket joints located on a circle about said drive flange axis, (d) a barrel support pivotable relative to the drive flange about a pivot axis located in a plane perpendicular to said drive flange axis, (e) said cylinder barrel being supported in said drive flange in a tilting point, said tilting point being the intersection of the axes of said drive flange and of said cylinder barrel, and said cylinder barrel being further supported in said barrel support, (f) a valving body supported in said barrel support and retained non-rotatable therein, said valving body having a valving surface with two diametrically opposite, arcuate valving ports, each valving port extending over slightly less than 180°, one of said valving ports communicating through a passage with a fluid inlet defined in the said barrel support, and the other one of said valving ports communicating through a passage with a fluid outlet defined in said barrel support, said valving surface engaging said remote end face of said cylinder barrel, (g) coupling means for coupling said cylinder barrel with said drive flange to rotate said cylinder barrel substantially in synchronism with said drive flange, (h) wherein said valving surface of said valving body is convex-spherical, said remote end face of said cylinder barrel engaged thereby being of concave-spherical shape complementary thereto, (i) said valving body is guided on the barrel support and held against rotation about said barrel axis but is laterally movable to permit lateral alignment of the valving body with the cylinder barrel, (j) pressure fields are defined between said valving body and said barrel support, said pressure fields being connected to fluid pressure to generate forces which pass through the centers of force of said pressure fields and are normal to said spherical valving surface, (k) said pivot axis of said barrel support is substantially tangential to said circle, (l) said valving body has a concave roof-shaped surface facing said barrel support and comprising two halves on both sides of a center line which forms an obtuse angle, and (m) said barrel support has a slightly roof-shaped surface facing said valving body and substantially complementary to said concave roof-shaped surface of said valving body, thus comprising two halves on both sides of a center line, and said pressure fields being arranged between said halves of said complementary roof-shaped surfaces of said valving body and said barrel support.

12. An axial piston type motor as claimed in claim 11, wherein said valving body has a straight groove of rectangular cross section extending along said center line between said halves of said surface, said barrel support has a straight groove of rectangular cross section extending along said center line between the two halves of said roof-shaped surface, said two grooves together defining a passage of rectangular cross section, and a prismatic guiding element is arranged in said rectangular passage, said guiding element having two convex-cylindrical said faces engaging the bottom surfaces of the grooves and having two concave cylindrical side faces therebetween, whereby said guiding element permits relative displacement of said valving body and said barrel support parallel to said center lines and a limited lateral compensating movement, during which the convex-cylindrical side faces roll off on the bottom surfaces of said grooves.

* * * * *